US006421962B2

(12) United States Patent
McNamara

(10) Patent No.: US 6,421,962 B2
(45) Date of Patent: Jul. 23, 2002

(54) SWIMMING POOL ASSEMBLY

(76) Inventor: Bernard McNamara, Grattan Bridge House, 3 Upper Ormond Quay, Dublin 7 (IE)

( * ) Notice: Subject to any disclaimer, the term of this patent is extended or adjusted under 35 U.S.C. 154(b) by 0 days.

(21) Appl. No.: 09/838,587

(22) Filed: Apr. 20, 2001

(30) Foreign Application Priority Data

Apr. 20, 2000 (IE) ..... S2000/0294

(51) Int. Cl.[7] ..... E04B 1/346

(52) U.S. Cl. ..... 52/64; 52/66; 52/122.1; 4/498; 4/500; 4/503

(58) Field of Search ..... 52/64, 66, 122.1, 52/125.1, 126.1, 126.5, 169.7; 4/498, 500, 503, 504, 505

(56) References Cited

U.S. PATENT DOCUMENTS 4,598,506 A 7/1986 Nohl et al.
5,271,483 A 12/1993 Hong

FOREIGN PATENT DOCUMENTS

GB 2167951 A 6/1986

*Primary Examiner*—Carl D. Friedman
*Assistant Examiner*—Kevin McDermott
(74) *Attorney, Agent, or Firm*—Jacobson Holman, PLLC

(57) ABSTRACT

A swimming pool cover is provided for a swimming pool which can be lowered to cover portion of the room floor and can be then raised to a position above the pool and adjacent the ceiling. The cover is suspended from the ceiling by various wire ropes and associated winches.

39 Claims, 14 Drawing Sheets

SWIMMING POOL ASSEMBLY

FIELD OF THE INVENTION

The present invention relates to a swimming pool and particularly to an indoor swimming pool assembly for a room.

BACKGROUND OF THE INVENTION

One of the biggest problems with indoor swimming pools is that when they are not in use, the room in which the swimming pool is placed is effectively useless in the sense that nothing else can be done with the room. Further, since swimming pools are generally rather large, this means that there is a considerable waste of space and as space becomes less available, people are in turn less prepared to have indoor swimming pools. It is known to have an indoor swimming pool with a floor in the bottom of the pool, which floor can be raised or lowered as the case may be. When in the raised position, the floor of the swimming pool can be flush with the surrounding floor of the building. Thus effectively the swimming pool floor can be used as a building floor and the room can be used normally. There are certain problems with this in that the pool very often has to be emptied and if it is not emptied, the floor has to have holes and recesses to allow the floor to be raised in the water and this can take some considerable time. In fact, with most of these arrangements, if it has been found necessary to empty the pool each time. The floor is generally raised on hydraulic jacks and this in turn causes problems in that it is not possible, for example, to have a sloping floor in the pool since such a sloping floor would not be suitable, when raised, for ordinary use. Also, because the floor is submerged, there are general difficulties of raising something that is wet which can take some considerable time to dry. In many instances, while in theory the floor of the pool is raised to turn the swimming pool area into a dry area, it does not happen in practice.

U.S. Pat. No. 4,598,506 (Nohl et al) describes another type of swimming pool cover for an indoor pool which is designed to form a supporting floor when in place that is a continuation of the existing floor and which can be raised up vertically when the pool is to be used and become a false ceiling. A very elaborate construction is provided in which the cover is provided with vertical guides in the form of posts which support the cover as it is raised and lowered. The problem with such an arrangement is that there is now ancillary equipment within the room which thus causes some obstruction within the room.

The present invention is directed towards providing an improved construction of such a swimming pool cover which will obviate the need to remove water from the pool and further, which will provide a cover than can be readily easily raised and lowered.

The main problem with such a cover is to ensure that the cover can be raised and lowered so as to always nest within the pool to form an extension of the floor and that this can be done safely and efficiently.

SUMMARY OF THE INVENTION

In accordance with the invention, there is provided an indoor swimming pool assembly for a room having a room floor, room walls and a ceiling, the swimming pool is recessed in the room floor and has a pool floor and pool side walls. The swimming pool also has a swimming pool cover which can be raised vertically from a position covering the pool to form portion of the room floor to a raised position above the pool and adjacent the ceiling to effectively form portion of the ceiling. The invention provides a cover which is suspended from the ceiling by flexible connectors and an associated powered winch; the flexible connectors are releasably connected to the cover and a winch controller and an associated cover stability detector is provided whereby during movement of the cover, the winch is stopped if the cover moves out of the horizontal or rotates relative to the room floor by more than preset amounts. In this way, the safe and accurate positioning of the cover either in the pool to form an extension of the floor or against the ceiling, is accurately and safely controlled. Any failure of any of the lifting equipment or any movement of the cover out of the horizontal and vertical position above the pool will be immediately detected and will cause the pool cover to stop being raised or lowered until the fault has been corrected.

Ideally, the flexible connectors are connected to a lifting frame at spaced-apart locations, the lifting frame having upper and lower faces, side edges and mounting releasable connectors for engagement with the pool cover and in which the cover stability detector is mounted on the lifting frame for control of the movement of the lifting frame when it is not attached to the cover. In this way, by separating the lifting frame from the cover, it is possible to ensure that the connectors are easily mounted on the cover without the need for human intervention. This further improves the safety of the operation.

Ideally, each releasable connector comprises a threaded socket mounted in the cover; and a threaded connector probe and drive motor assembly mounted on the lifting frame, the free end of the probe projecting proud of the lower face of the lifting frame.

Preferably, the threaded connector probe tapers towards its free end and in which the threaded socket is mounted below a tapering guide having a probe receiving mouth and a reducing cross section between the probe receiving mouth and an entrance to the socket.

In one embodiment of the invention, the tapering guide is of a resilient material and ideally, an interlock proving switch is provided to confirm engagement and disengagement of each probe and socket and in which each interlock proving switch is connected to the winch controller. In this way, until the actual connector has been placed and locked in position, the assembly will not operate.

Ideally, separate locking means is provided to secure the cover in the raised position. This locking means may comprise a locking pin rigidly mounted in the room and movable laterally to engage in a socket in the side edges of the lifting frame and again ideally, an interlock proving switch is provided to confirm engagement and disengagement of each locking pin and socket and in which each interlock proving switch is connected to the winch controller.

In one embodiment of the invention, the cover stability detector is a slewing detector. Preferably, motion detection equipment is mounted in the room and connected to the winch controller whereby movement in and around the pool causes the winch to stop. In this way, one can ensure that the assembly does not operate until the room has been cleared of people at least around the periphery of the pool and indeed within the pool.

Ideally, each flexible connector comprises a pair of side-by-side wire ropes which are reeved over separate winches. The idea of reeving the various wires in such a manner that each wire of any pair originates from a different drum to the other wire, is to ensure an even work load from the winch drums in the event of uneven wire tensioning. Ideally, each wire rope will incorporate tensioning means and preferably will have a slack rope connector detector mounted below each wire rope where it runs substantially horizontally again to detect any malfunction.

BRIEF DESCRIPTION OF THE DRAWINGS

The invention will be more clearly understood from the following description of some embodiments thereof, given by way of example only, with reference to the accompanying drawings, in which.

DETAILED DESCRIPTION OF PREFERRED EMBODIMENTS

Figure 1:
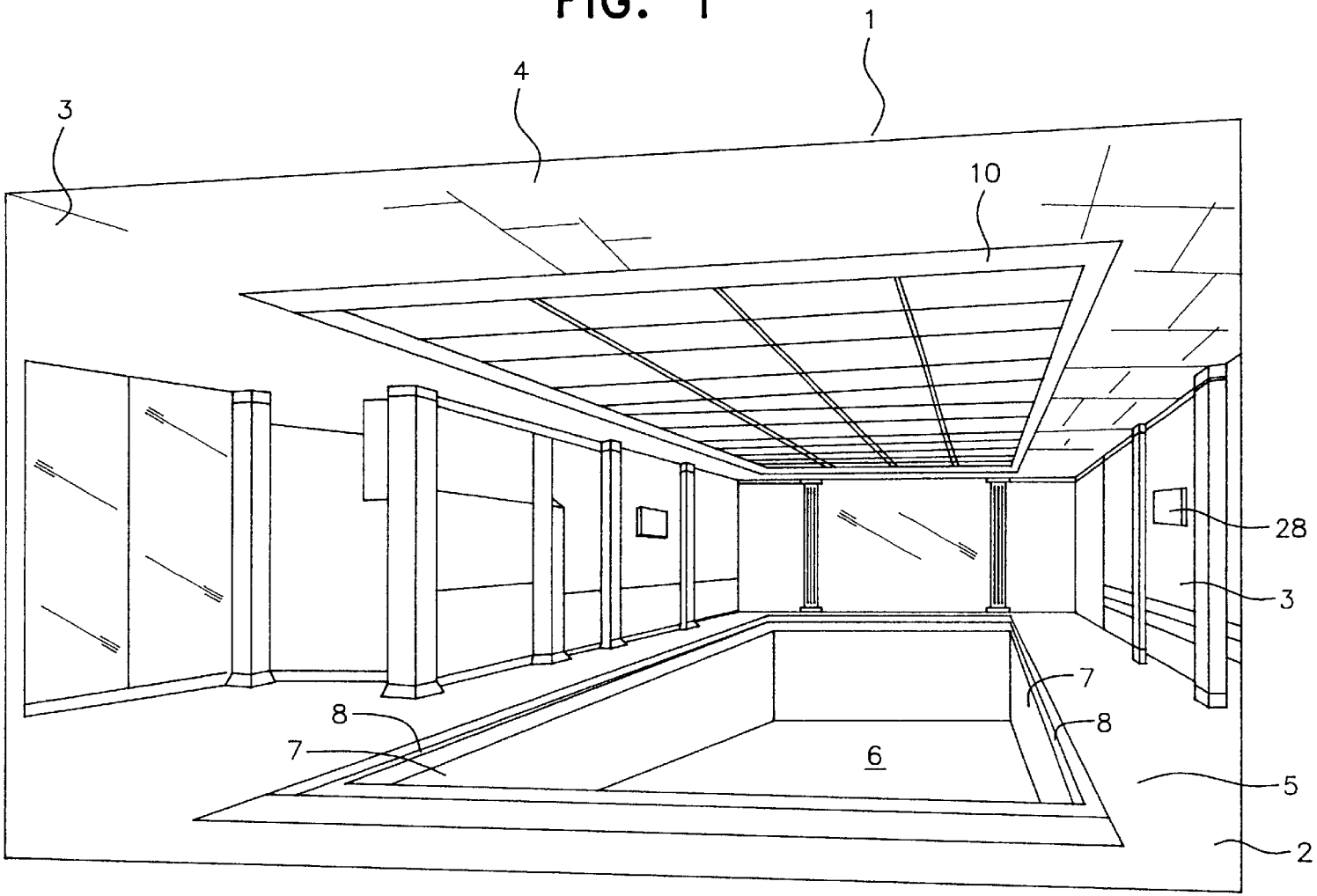
FIG. 1 is a perspective view of a room and pool assembly according to the invention.

Referring to FIG. 1, there is illustrated an indoor swimming pool assembly, indicated generally by the reference numeral 1, for a room having a floor 2, room walls 3, ceiling 4 and a sunken swimming pool, indicated generally by the reference numeral 5. The swimming pool 5 comprises a pool floor 6 and side walls 7 recessed adjacent the upper edge to form support ledges 8. There is also illustrated a pool cover 10 in the raised position against the ceiling 4.

Before describing the invention in detail, reference is now made to FIGS. 2 to 5 inclusive, where the essential elements of the invention are illustrated in diagrammatic form. The pool cover 10 is raised and lowered by two lifting frames 20 carrying connectors 25 for engagement at locations 26 with the pool cover 10, which lifting frames 20 are suspended from the ceiling 4 by flexible connectors 30 reeved through various pulleys 35 onto powered winches 40(*a*) and 40(*b*), in turn connected to a winch controller 45. Each lifting frame 20 mounts a cover stability detector 50.

Figure 2:
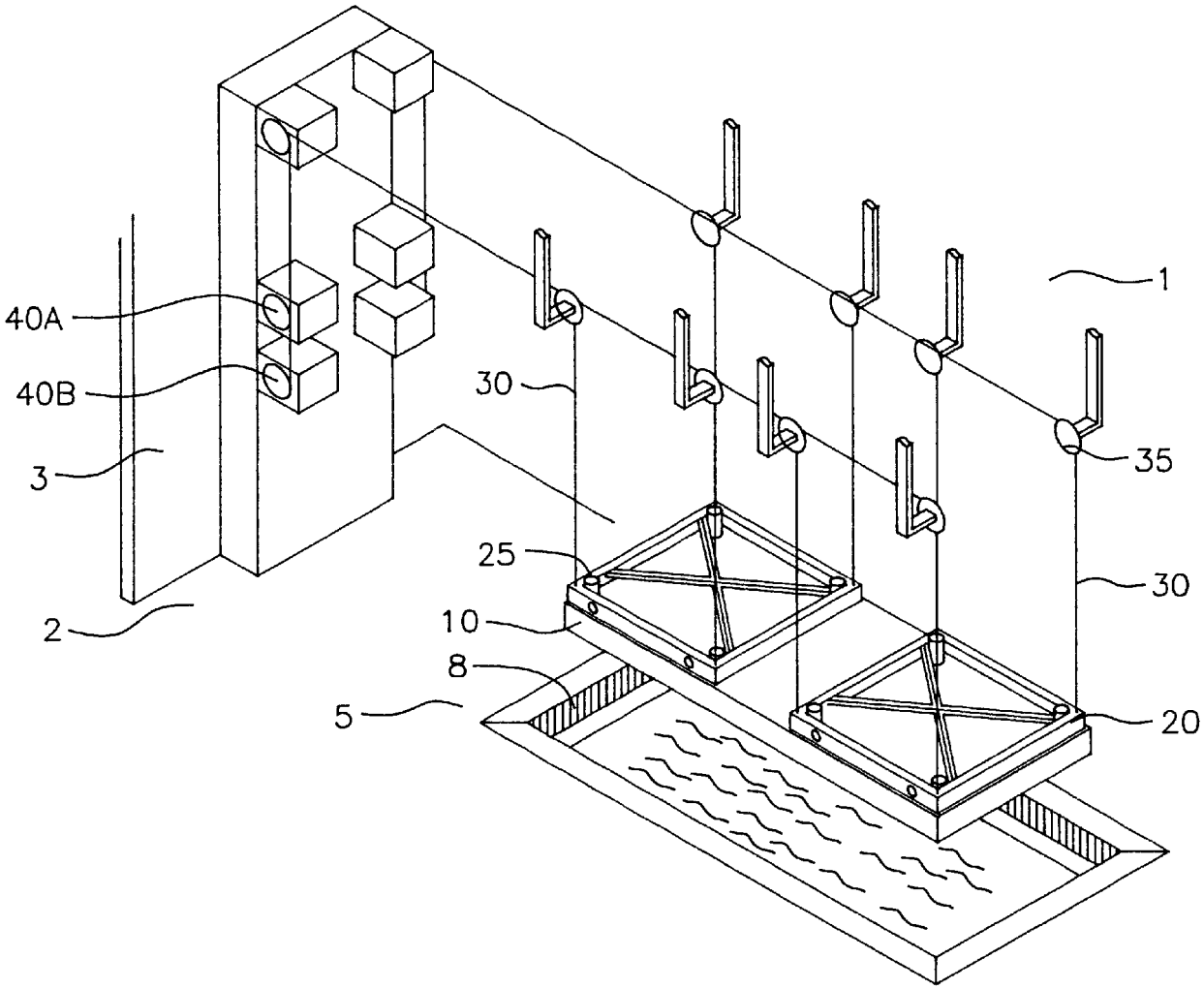
FIG. 2 is a diagrammatic view showing operation of the invention.
Figure 3:
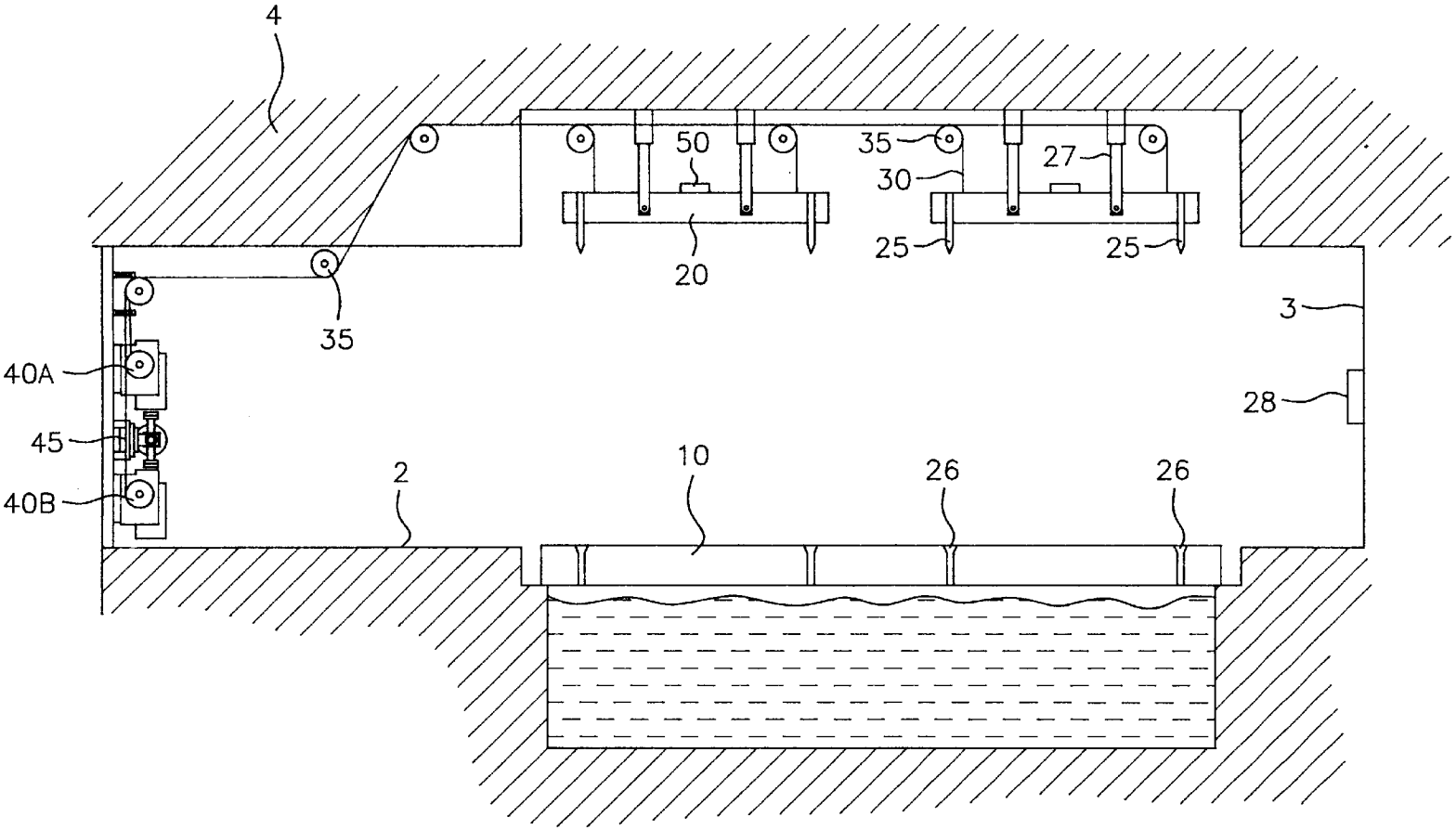
FIGS. 3 to 5 are front diagrammatic views showing operation of the invention.
Figure 4:
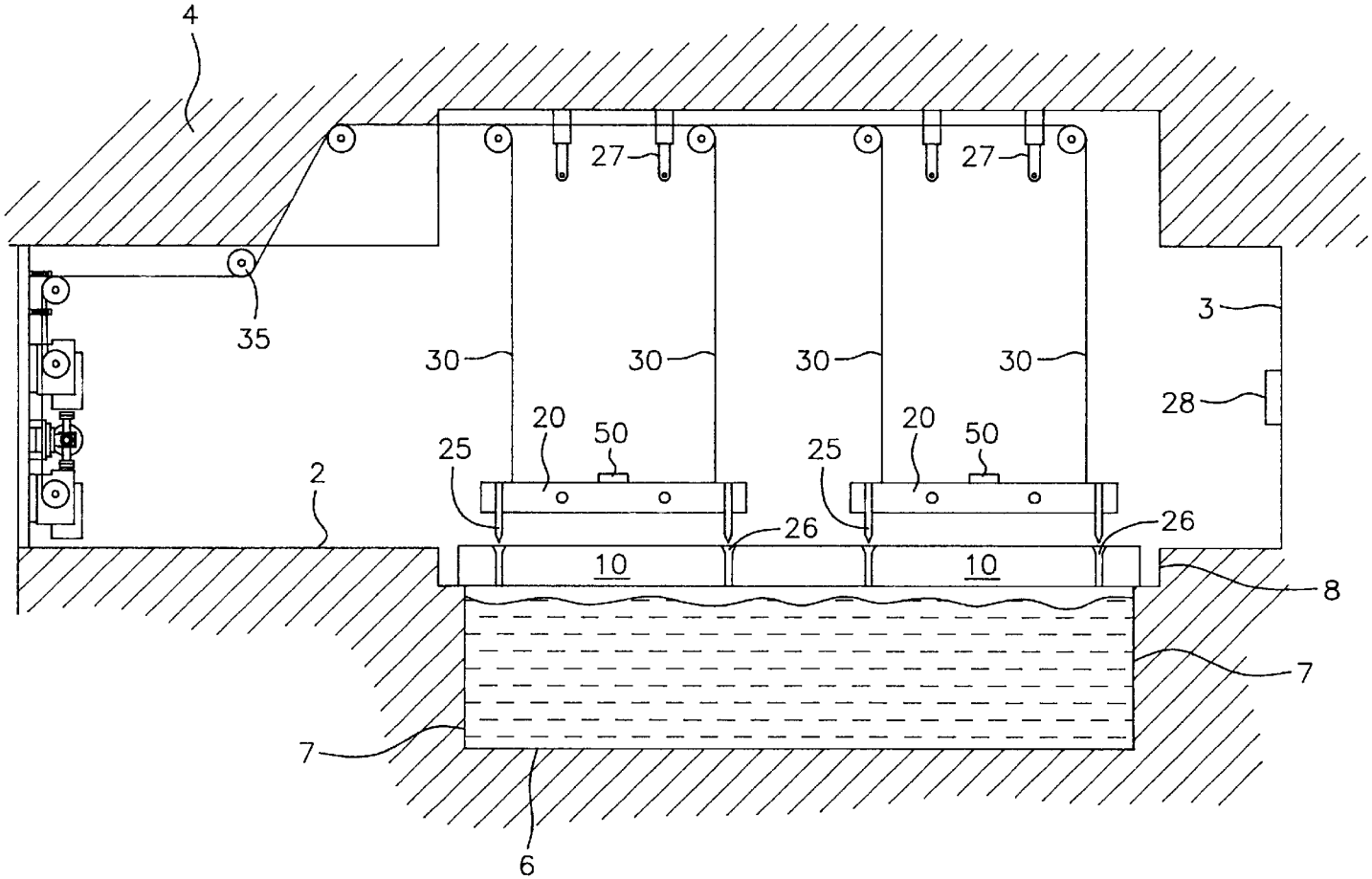
Figure 5:
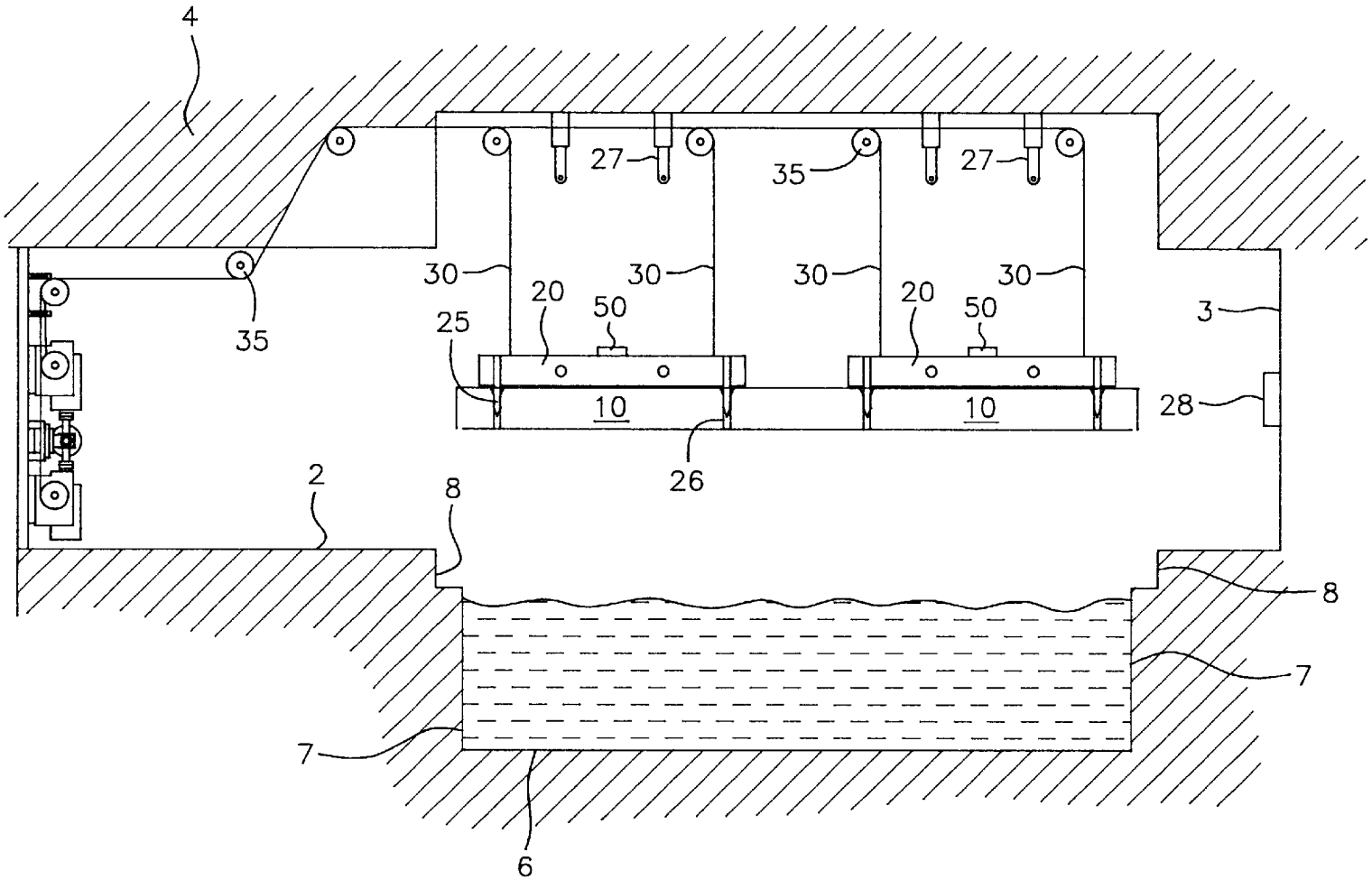
Figure 6:
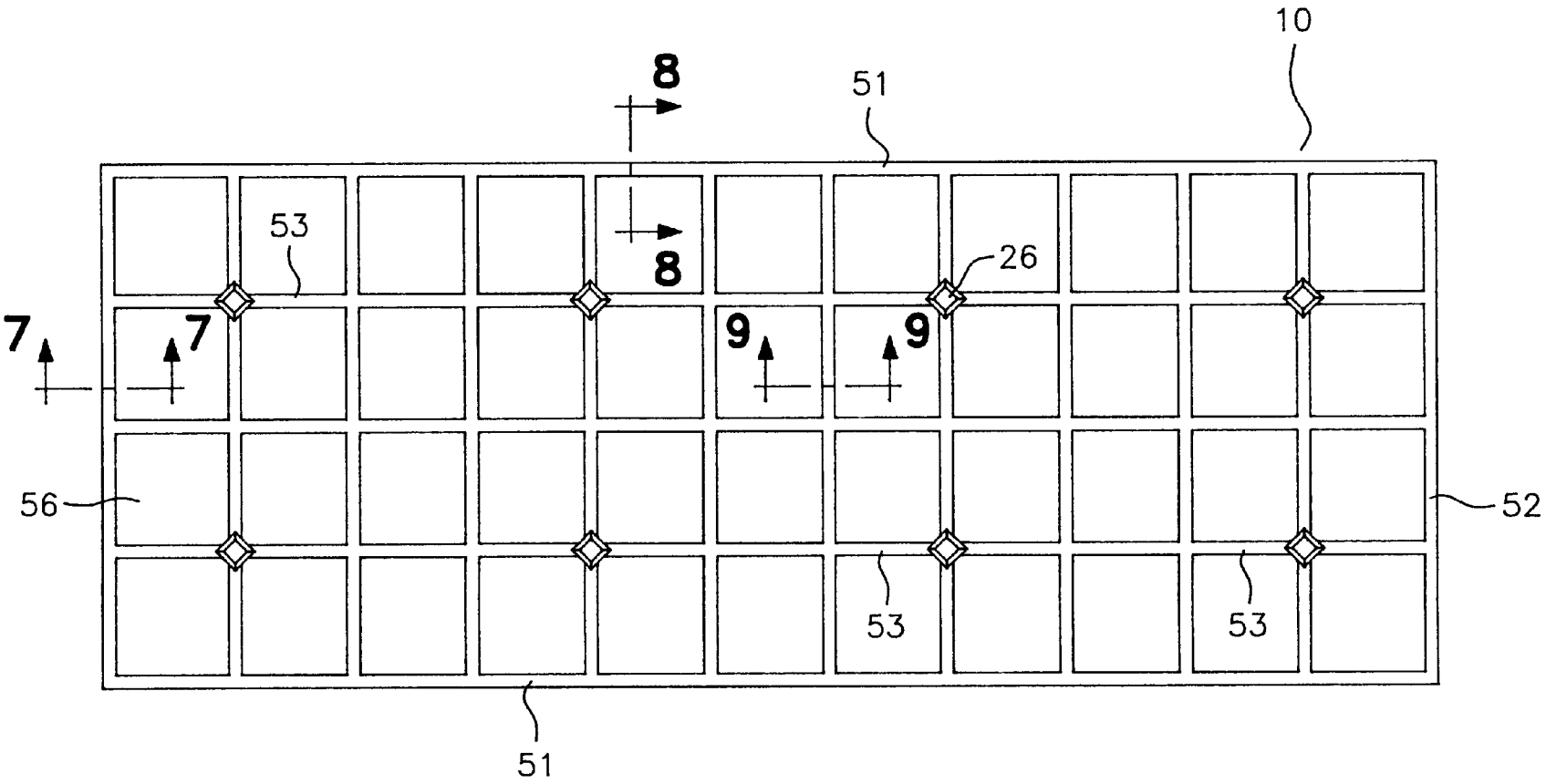
FIG. 6 is a plan view of a pool cover according to the invention.
Figure 7:
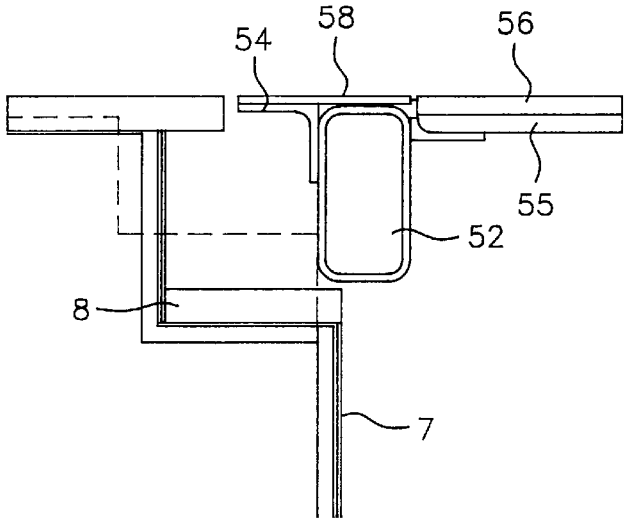
FIG. 7 is a section view along the lines VII—VII of FIG. 6.
Figure 8:
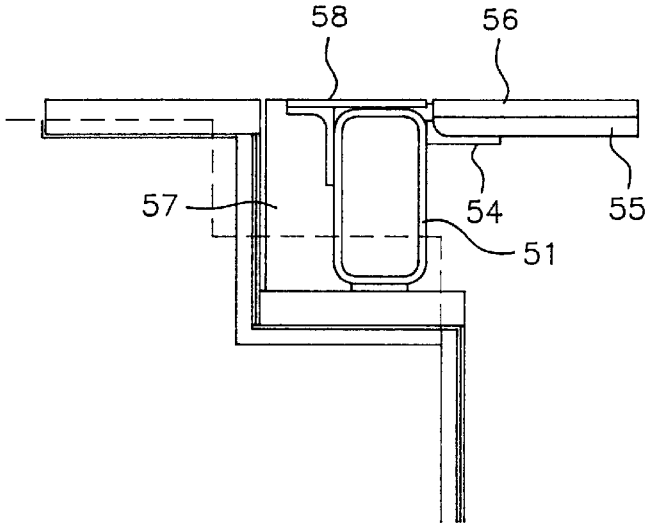
FIG. 8 is a section view along the lines VIII—VIII of FIG. 6.
Figure 9:
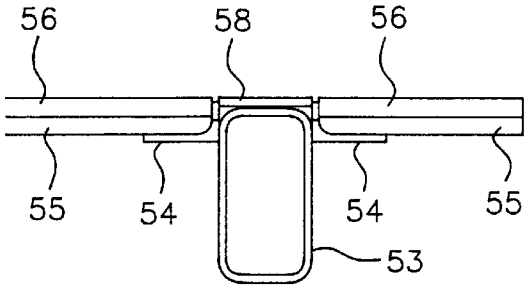
FIG. 9 is a section view along the lines IX—IX of FIG. 6.

Referring now to FIG. 3, the pool cover 10 is illustrated in position over the pool and the lifting frames 20 are shown in the raised position against the ceiling 4. FIG. 4 shows the lifting frames 20 lowered into proximity with the pool cover 10 with the connectors 25 extended to engage locations 26 in the pool cover 10. Locking means, indicated generally by the reference numeral 27, are provided for securing the pool cover 10 and lifting frame 20 in position against the ceiling 4. Motion detectors 28 are provided around the room on the room walls 3. FIGS. 2 and 5 show the pool cover being raised.

Referring to FIGS. 6 to 10 inclusive, there is illustrated in more detail the pool cover 10. The pool cover 10 is fabricated from a number of extruded steel sections comprising two outer longitudinal members 51 and two outer transverse members 52, together with internal members 53. The outer longitudinal members 51 and the outer transverse members 52 each carry a support angle 54, while the internal transverse member 53 carries two support angles 54. On top of each support angle 54, there is mounted a neoprene block 55 supporting a pane of glass 56. A silicone guide block 57 is mounted on the exterior of each outer longitudinal member 51. A slate capping piece 58 is mounted on each member 51, 52 and 53.

Figure 10:
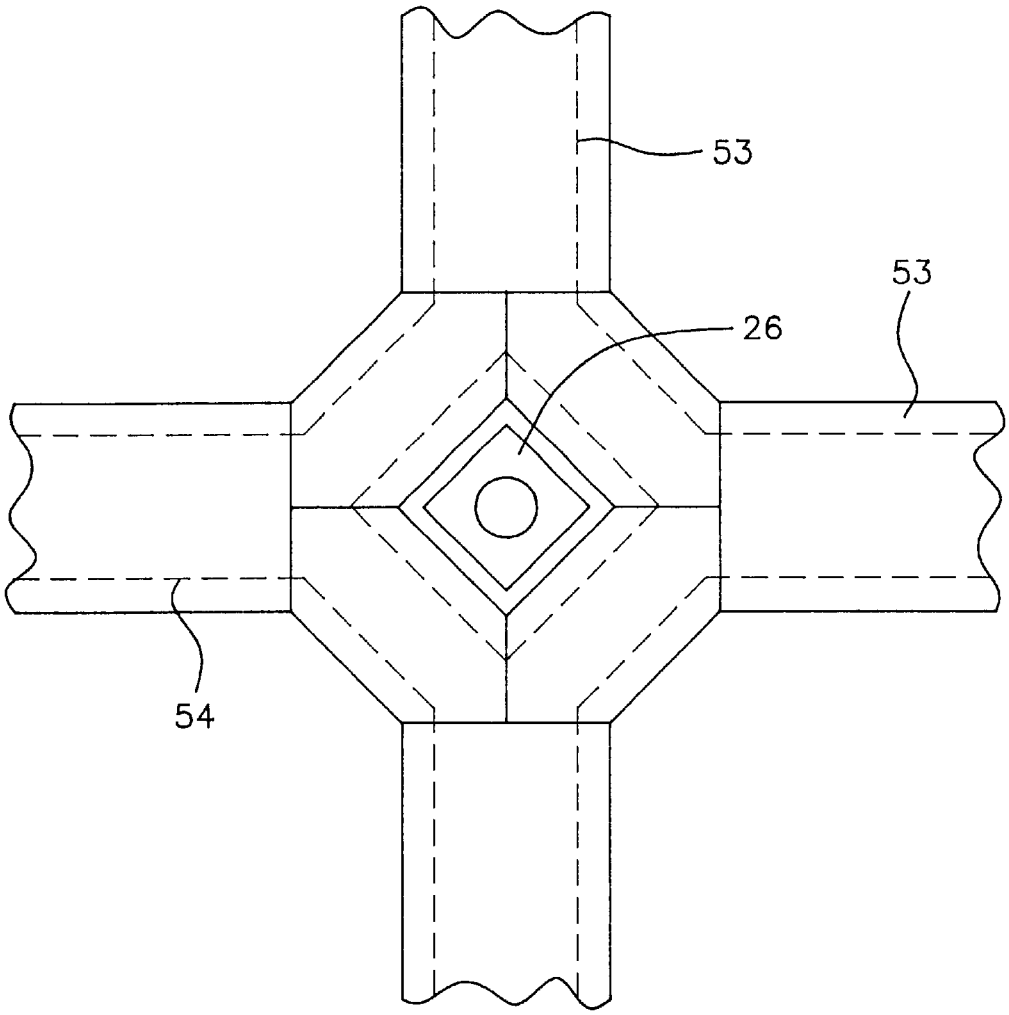
FIG. 10 is an enlarged detail of portion of the pool cover illustrated in FIG. 6.
Figure 11:
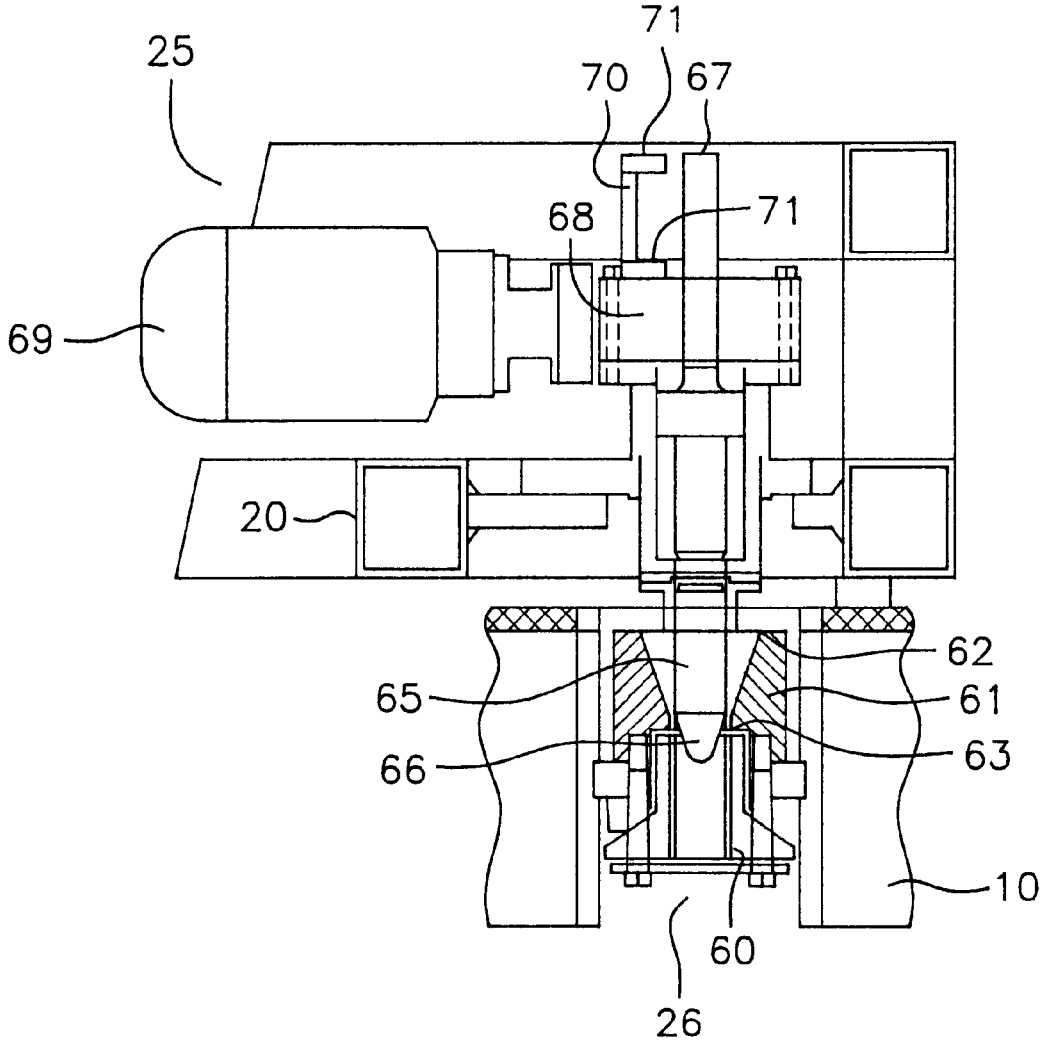
FIG. 11 is a detailed view of a connector according to the invention.

Referring now to FIGS. 10 and 11, a portion of the lifting frame 20 and the pool cover 10 is illustrated. The remainder of the lifting frame 20 will be described below. Mounted on the lifting frame 20 is the connector 25 engaging the location 26 in the pool cover 10. At each location 26, there is mounted a threaded socket 60 below a tapering guide 61 having a probe receiving mouth 62. The tapering guide 61 has a tapering section between the probe receiving mouth 62 and an entrance 63 to the socket 60. The tapering guide 61 is manufactured of a suitable resilient material such as neoprene. The connector 25 further comprises a threaded connector probe 65 tapering at its free end 66. The probe 65 is mounted on a drive spindle 67 driven through a gearbox 68 by a drive motor 69 forming a drive motor assembly. An interlock proving switch 70 provided by two limit switches 71 is provided to confirm engagement and disengagement of each probe 65 within its socket 60. The interlock proving switch 70 is connected to the winch controller 45.

Figure 12:
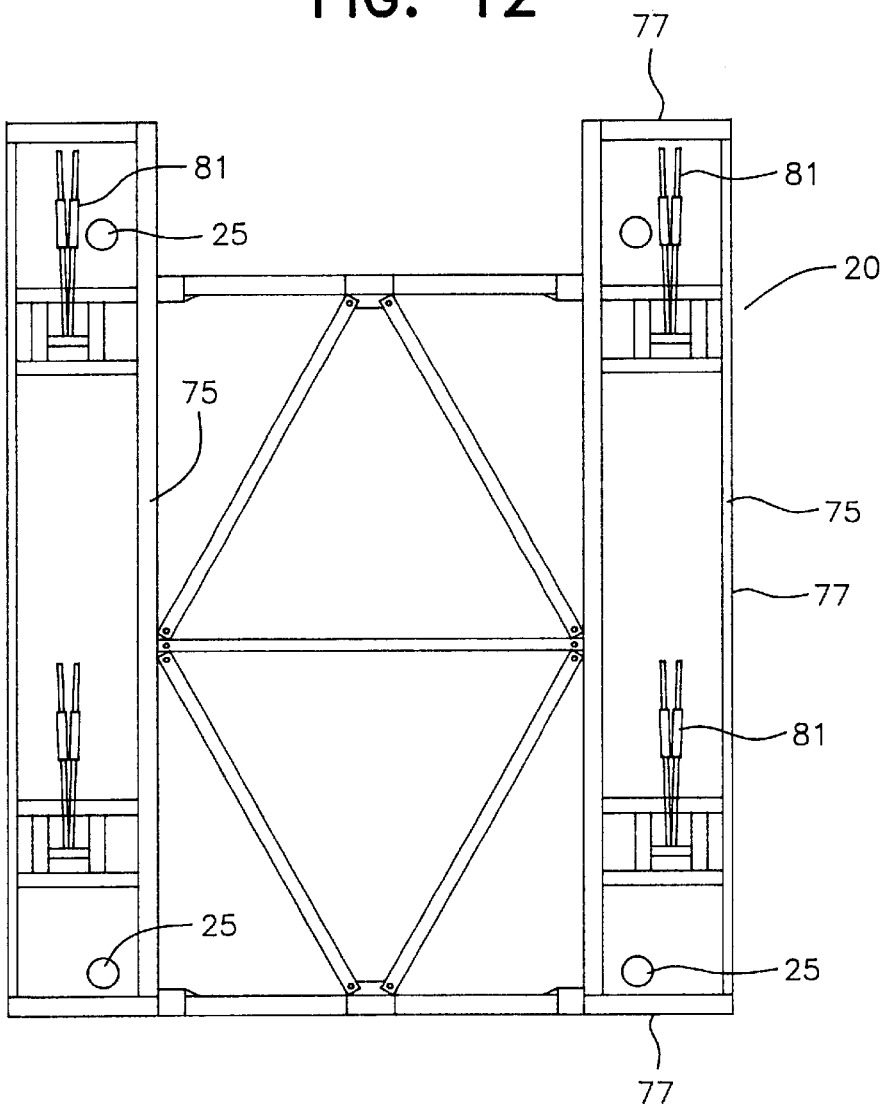
FIG. 12 is a plan view of a lifting frame according to the invention.
Figure 13:
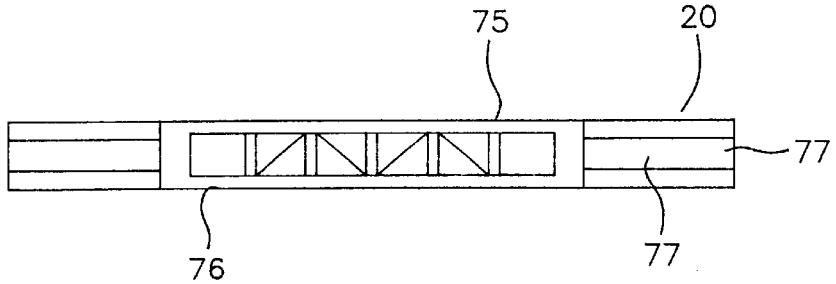
FIG. 13 is an end view of the lifting frame.
Figure 14:
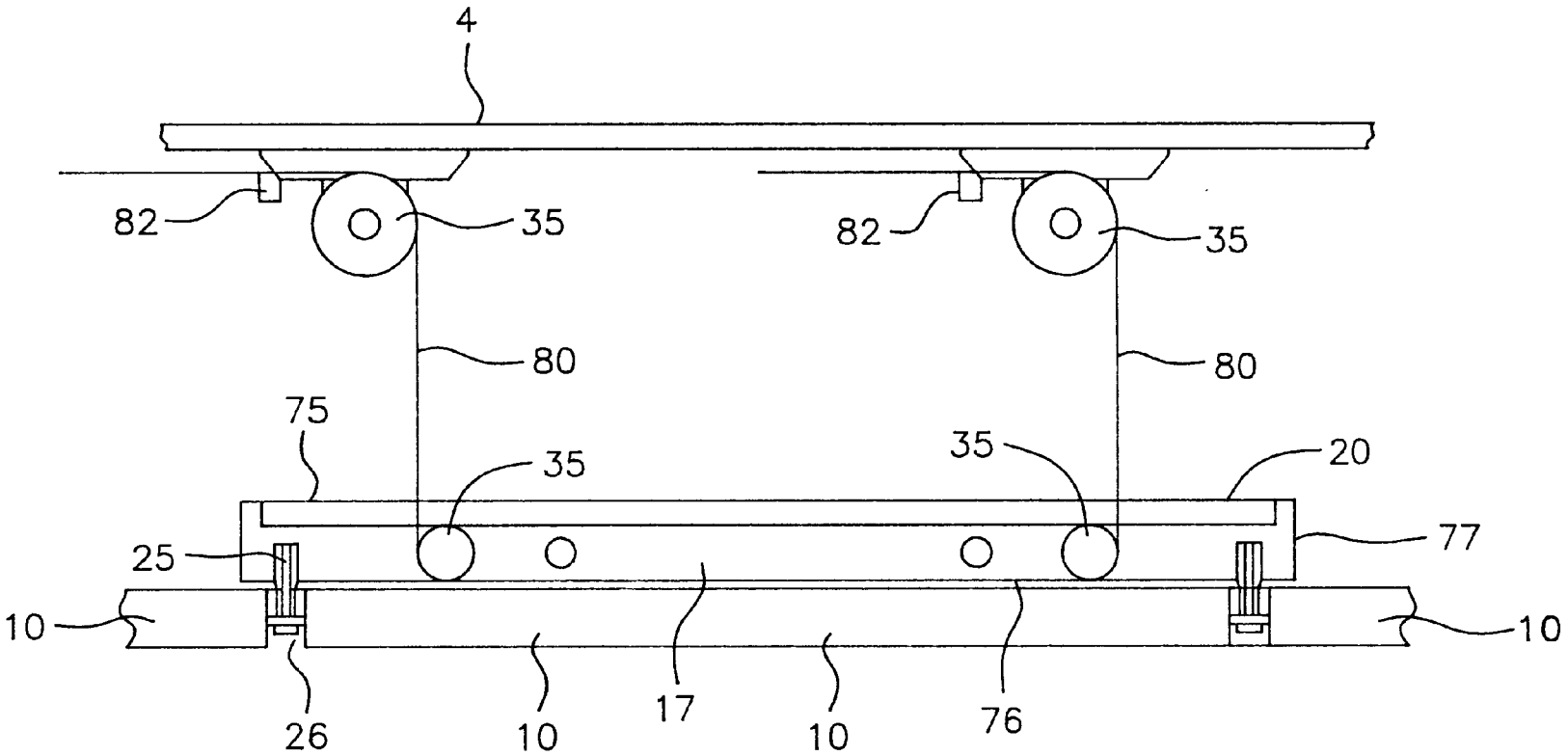
FIG. 14 is a front view of the lifting frame shown suspended from the ceiling and carrying the pool cover.

Referring now to FIGS. 12 to 14, there is illustrated the lifting frame 20. The lifting frame 20 is essentially an open framework having an upper face 75, a lower face 76 and side edges 77. The flexible connectors each comprise a pair of side-by-side wire ropes 80 each anchored by a disc-spring assembly forming tensioning means 81. Slack rope connector detectors 82 are mounted below each wire rope 80 where it runs substantially horizontally.

Figure 15:
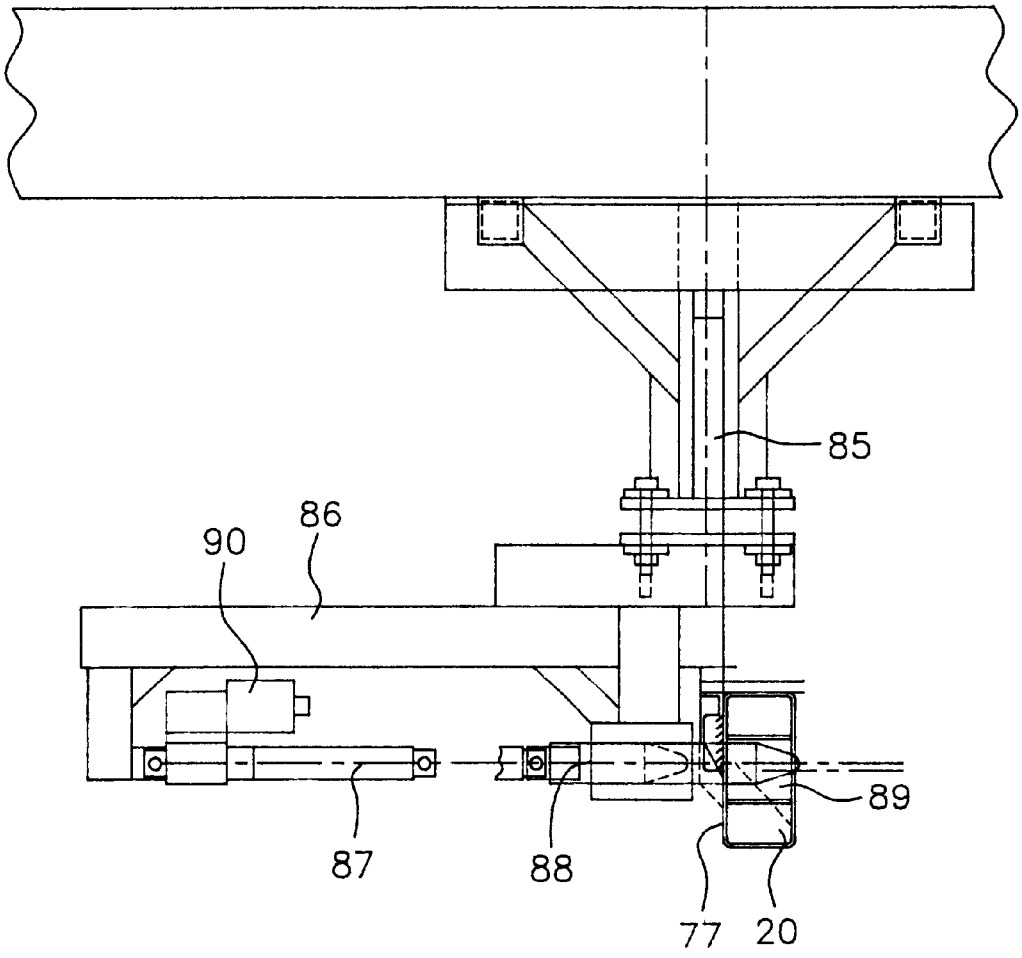
FIG. 15 is a view of a locking means according to the invention.

Referring to FIG. 15, the locking means comprises a bracket 85 mounting a cantilevered arm 86 mounting a ram 87, in turn mounting a locking pin 88 which is movable laterally to engage a socket 89 in the side edge 77 of the lifting frame 20. An interlock proving switch 90 is provided and connected to the winch controller 45.

Figure 16:
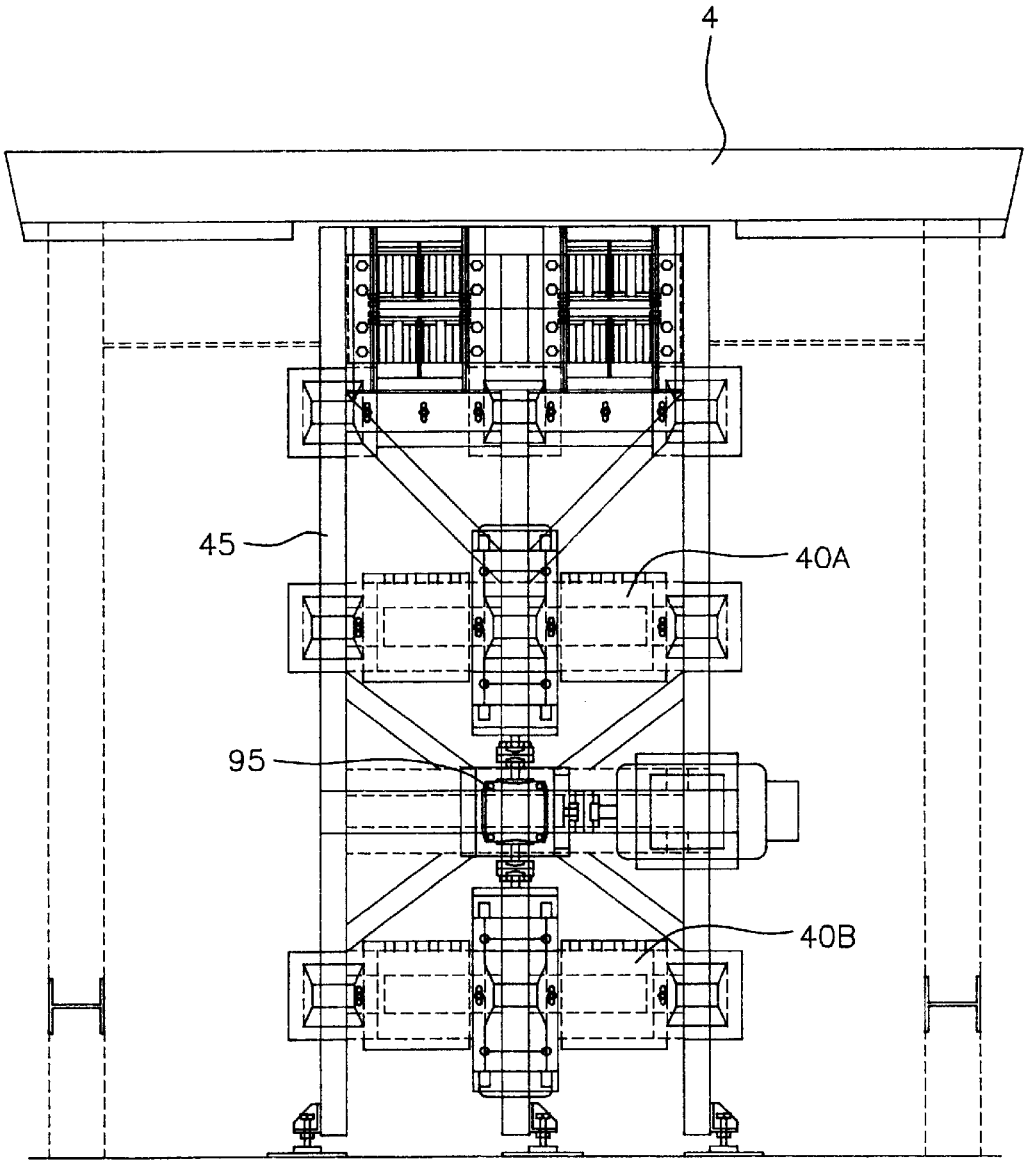
FIG. 16 is an end view of portion of a powered winch assembly according to the invention.
Figure 17:
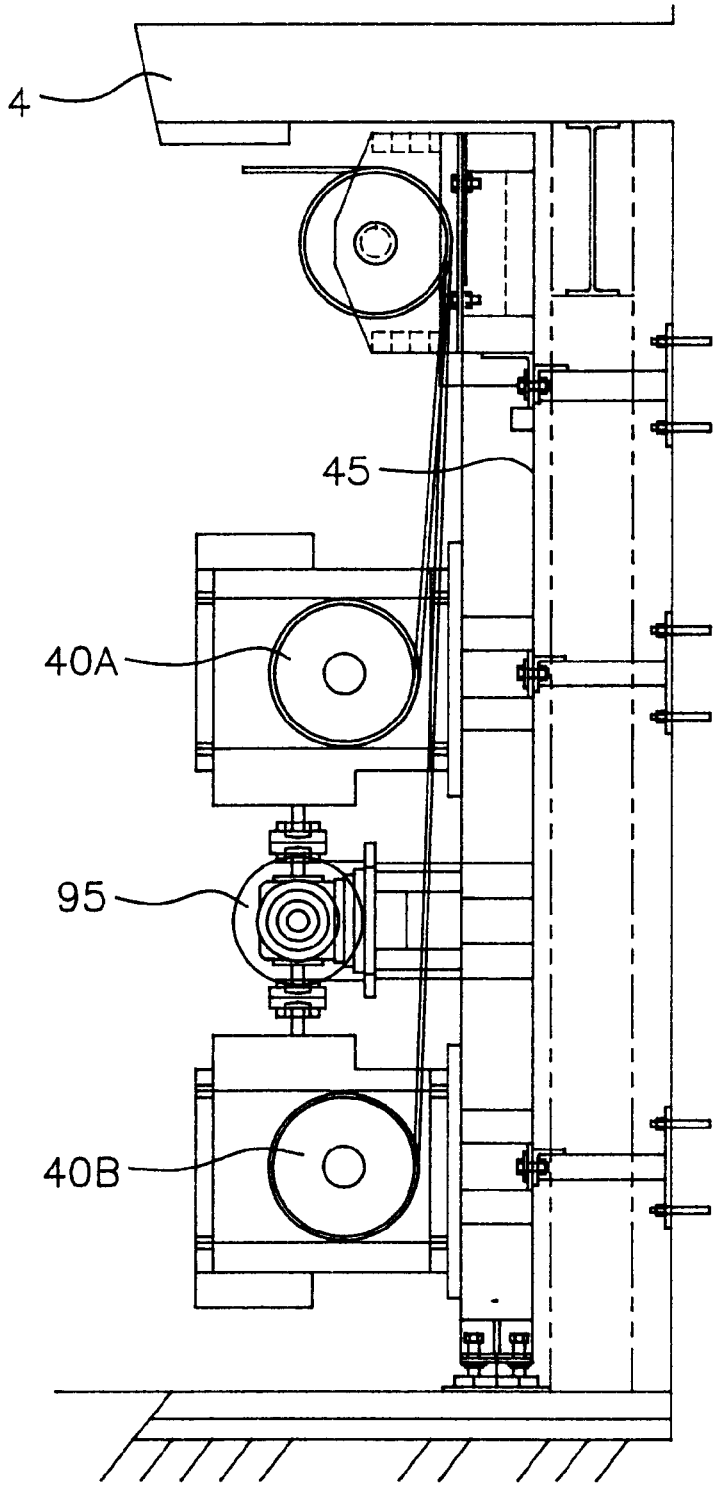
FIG. 17 is a side view of the winch assembly.

Referring now to FIGS. 16 and 17, it will be noted that the two winches 40(*a*) and 40(*b*) are both driven by the one motor 95. Each wire rope 80 forming one flexible connector 30 is reeved over one of each of the hard winches 40(*a*) and 40(*b*). By making sure that each wire rope of any pair originates from a different drum to the other rope, it ensures an even workload from the winch drums in the event of an even rope tensioning.

In operation, when it is desired to raise or lower the pool cover, people have to be cleared out from around the pool area or the motion detectors 28 will prevent any operation of the equipment. Presuming that the pool cover is against the ceiling 4 and it is desired to lower the pool cover, firstly the locking means 27 are retracted so as to free the lifting frames 20. Then the power winches 40A and 40B are operated to initially lower the lifting frames 20 and pool cover 10 slowly and then quicker until the pool cover 10 approaches the floor 2 at which stage the lowering is slowed down until the pool cover 10 is spaced a small distance apart from the pool 5 when the pool cover and lifting frame 20 will be lowered until the pool cover engages on the support ledge 8. Then, the connectors 25 will be rotated and unscrewed and the lifting frame 20 removed free of the pool cover 10 up against the ceiling 4 where it will be secured in position by the locking means 27. When it is subsequently desired to raise the pool cover 10, the lifting frames 20 will be lowered as before until the lifting frames 20 are almost resting on the pool cover 10 when the connectors 25 will be used to engage the threaded socket 60. When they are fully engaged as indicated by the limit switches 71, the pool cover 10 and lifting frame 20 can be raised. If at any stage during the raising or lowering, the cover stability detector 50 senses that the pool cover is no longer horizontal or the pool cover has moved out of the correct vertical position, the necessary signal will be sent to the winch controller and further raising or lower will cease until the pool cover 10 or lifting frame 20, as the case may be, assumes the correct orientation.

The cover stability detector can be provided by many devices including slewing detectors. It may also include level and other detection means.

It will be appreciated that control integrity of all the locking and unlocking means are clearly provided by the various interlock proving switches 71. Essentially, the anti-slew detectors are formed by cable extension position transducers which monitor the lifting frames to ensure that they remain level and do not vary in position across the pool area. The slack wire detectors 82 will ensure that in the event of a wire rope becoming slack for any reason, the detector 82 will be activated and the winch controller will cause the powered winches 40 to stop.

It is envisaged that over travel switches may be fitted above the lifting frames 20 as an added safety precaution. They would normally only operate to prevent upward motion of the equipment in the event of failure of some of the other switches.

It is envisaged that the underside of both the pool cover 10 and the lifting frame 20 will be provided with suitable cladding so as to provide a suitable ceiling when exposed.

In the specification the terms "comprise, comprises, comprised and comprising" or any variation thereof and the terms "include, includes, included and including" or any variation thereof are considered to be totally interchangeable and they should all be afforded the widest possible interpretation.

The invention is not limited to the embodiments hereinbefore described but may be varied in both construction and detail.

What is claimed is:

1. An indoor swimming pool assembly for a room having a room floor, room walls and ceiling comprising:

a swimming pool recessed in the room floor, the swimming pool including a pool floor and pool side walls;

a support ledge formed by a peripheral recess in the pool side walls below the room floor;

a swimming pool cover comprising a planar structure of dimensions such as to allow the cover to rest on the support ledge with the top surface of the cover substantially co-planar with the room floor to form a portion of the room floor;

a plurality of flexible connectors mounted between the room ceiling and the swimming pool cover by releasable engagement means;

a winch comprising a winch drum;

a winch motor to drive the winch drum for winding and unwinding the flexible connectors for raising the swimming pool cover from a position nesting in the swimming pool to a raised position adjacent the ceiling;

a winch controller for controlling the operation of the winch motor;

means for releasably connecting the flexible connectors to the cover; and a stability connector mounted on the cover for detecting any movement of the cover out of the horizontal or about the vertical, the stability detector being connected to the winch controller whereby any tilting or rotation of the cover during raising and lowering beyond preset acceptable amounts causes the winch controller to stop the winch motor until the cover resumes a suitable stable position within the room.

2. An assembly as claimed in claim 1, in which separate locking means are provided to secure the cover in the raised position.

3. An assembly as claimed in claim 1, in which the cover stability detector is a slewing detector.

4. An assembly as claimed in claim 1, in which motion detection equipment is mounted in the room and connected to the winch controller whereby movement in and around the pool causes the winch to stop.

5. An assembly as claimed in claim 1, in which each flexible connector comprises a pair of side-by-side wire ropes which are reeved over separate winch drums.

6. An assembly as claimed in claim 1, in which each flexible connector is a wire rope and incorporates tensioning means.

7. An assembly as claimed in claim 1, in which each flexible connector comprises a pair of side-by-side wire ropes, each of which is reeved over a separate winch drum and further incorporates tensioning means.

8. An assembly as claimed in claim 1, in which each flexible connector is a wire rope and a slack connector detector is mounted below each wire rope where it runs substantially horizontally.

9. An assembly as claimed in claim 1 comprising:

a pair of side-by-side wire ropes forming each flexible connector;

a separate winch drum for each of the side-by-side wire ropes; and a slack rope connector detector mounted below each wire rope where it runs substantially horizontally.

10. An assembly as claimed in claim 1, in which the means for releasably connecting the flexible connectors to the cover comprises:

a lifting frame comprising a substantially planar structure having upper and lower faces and side edges, connection means on the upper face for securement of the flexible connections thereto at at least three out-of-line and spaced-apart locations;

releasable connectors on the lower face for support of the cover at at least three out-of-line and spaced-apart locations.

11. An assembly as claimed in claim 10, in which each releasable connector comprises:

a threaded socket mounted in the cover;

a threaded connector probe and drive motor assembly mounted on the frame, the free end of the probe projecting proud of the lower face of the frame.

12. An assembly as claimed in claim 10, in which the releasable connector comprises:

a threaded connector probe and drive motor assembly mounted on the frame, the free end of the probe projecting proud of the lower face of the frame and tapering towards its free end; and a threaded socket mounted on the cover below a tapering guide having a probe receiving mouth and a reducing cross section between the probe receiving mouth and the entrance to the socket.

13. An assembly as claimed in claim 10, in which the releasable connector comprises:

a threaded connector probe and drive motor assembly mounted on the frame, the free end of the probe projecting proud of the lower face of the frame and tapering towards its free end; and a threaded socket mounted on the cover below a tapering guide of a resilient material having a probe receiving mouth and a reducing cross section between the probe receiving mouth and the entrance to the socket.

14. An assembly as claimed in claim 10, in which an interlock proving switch is provided to confirm engagement and disengagement of each probe and socket and in which the interlock proving switch is connected to the winch controller.

15. An assembly as claimed in claim 10, in which separate locking means are provided to secure the cover in the raised position.

16. An assembly as claimed in claim 10, in which separate locking means are provided to secure the cover in the raised position, the locking means comprising a locking pin rigidly mounted in the room and movable laterally to engage in a socket in the side edge of the lifting frame.

17. An assembly as claimed in claim 10, comprising:

separate locking means to secure the cover in the raised position; and an interlock proving switch to confirm engagement and disengagement of the locking means, said interlock proving switch being connected to the winch controller.

18. An assembly as claimed in claim 10, comprising:

separate locking means comprising a locking pin rigidly mounted in the room and movable laterally to engage in a socket in the side edge of the lifting frame; and an interlock proving switch to confirm engagement and disengagement of each locking pin and socket, said interlock proving switch being connected to the winch controller.

19. An assembly as claimed in claim 10, in which the cover stability detector is a slewing detector.

20. An assembly as claimed in claim 10, in which motion detection equipment is mounted in the room and connected to the winch controller whereby movement in and around the pool causes the winch to stop.

21. An assembly as claimed in claim 10, in which each flexible connector comprises a pair of side-by-side wire ropes which are reeved over separate winch drums.

22. An assembly as claimed in claim 10, in which each flexible connector is a wire rope and incorporates tensioning means.

23. An assembly as claimed in claim 10, in which each flexible connector comprises a pair of side-by-side wire ropes, each of which is reeved over a separate winch drum and further incorporates tensioning means.

24. An assembly as claimed in claim 10, in which each flexible connector is a wire rope and a slack rope connector detector is mounted below each wire rope where it runs substantially horizontally.

25. An assembly as claimed in claim 10, comprising:

a pair of side-by-side wire ropes forming each flexible connector;

a separate winch drum for each of the side-by-side wire ropes; and a slack rope connector detector mounted below each wire rope where it runs substantially horizontally.

26. An indoor swimming pool assembly for a room having a room floor, room walls and ceiling comprising:

a swimming pool recessed in the room floor including a pool floor and pool side walls;

a support ledge formed by a peripheral recess in the pool side walls below the room floor;

a swimming pool cover comprising a planar structure of dimensions such as to allow the cover to rest on the support ledge with the top surface of the cover substantially co-planar with the room floor to form a portion of the room floor;

a plurality of flexible connectors mounted between the room ceiling and the swimming pool cover by releasable engagement means;

a winch comprising a winch drum;

a winch motor for winding and unwinding the flexible connectors for raising the swimming pool cover from a position nesting in the swimming pool to a raised position adjacent the ceiling;

a winch computer for controlling the operation of the winch motor;

a pair of lifting frames each comprising a substantially planar structure having upper and lower faces and side edges;

four spaced-apart connectors secured to the upper face of each lifting frame;

four releasable connectors on the lower face of each lifting frame for support of the cover; and a stability connector detector mounted on each lifting frame for detecting any movement of the lifting frame out of the horizontal or about the vertical, the stability detector being connected to the winch controller whereby any tilting or rotation of the cover during raising and lowering beyond preset acceptable amount, causes the winch controller to stop the winch motor until the cover resumes a suitable position within the room.

27. An assembly as claimed in claim 26, in which each releasable connector comprises:

a threaded socket mounted in the cover;

a threaded connector probe and drive motor assembly mounted on the frame, the free end of the probe projecting proud of the lower face of the frame.

28. An assembly as claimed in claim 26, in which the releasable connector comprises:

a threaded connector probe and drive motor assembly mounted on the frame, the free end of the probe projecting proud of the lower face of the frame and tapering towards its free end; and a threaded socket mounted on the cover below a tapering guide having a probe receiving mouth and a reducing cross section between the probe receiving mouth and the entrance to the socket.

29. An assembly as claimed in claim 26, in which the releasable connector comprises:

a threaded connector probe and drive motor assembly mounted on the frame, the free end of the probe projecting proud of the lower face of the frame and tapering towards its free end; and a threaded socket mounted on the cover below a tapering guide of a resilient material having a probe receiving mouth and a reducing cross section between the probe receiving mouth and the entrance to the socket.

30. An assembly as claimed in claim 26, in which an interlock proving switch is provided to confirm engagement and disengagement of each probe and socket and in which each interlock proving switch is connected to the winch controller.

31. An assembly as claimed in claim 26, in which separate locking means are provided to secure the cover in the raised position.

32. An assembly as claimed in claim 26, in which the cover stability detector is a slewing detector.

33. An assembly as claimed in claim 26, in which separate locking means are provided to secure the cover in the raised position, the locking means comprising a locking pin rigidly mounted in the room and movable laterally to engage in a socket in the side edge of the lifting frame.

34. An assembly as claimed in claim 26, comprising:

separate locking means to secure the cover in the raised position; and an interlock proving switch to confirm engagement and disengagement of the locking means, said interlock proving switch being connected to the winch controller.

35. An assembly as claimed in claim 26, comprising:

separate locking means comprising a locking pin rigidly mounted in the room and movable laterally to engage in a socket in the side edge of the lifting frame; and an interlock proving switch to confirm engagement and disengagement of each locking pin and socket, said interlock proving switch being connected to the winch controller.

36. An assembly as claimed in claim 26, in which each flexible connector comprises a pair of side-by-side wire ropes which are reeved over separate winch drums.

37. An assembly as claimed in claim 26, in which each flexible connector comprises a pair of side-by-side wire ropes, each of which is reeved over a separate winch drum and further incorporates tensioning means.

38. An assembly as claimed in claim 26, in which the releasable connector comprises:

a threaded connector probe and drive motor assembly mounted on the frame, the free end of the probe projecting proud of the lower face of the frame and tapering towards its free end; and a threaded socket mounted on the cover below a tapering guide having a probe receiving mouth and a reducing cross section between the probe receiving mouth and the entrance to the socket.

39. An assembly as claimed in claim 26, in which the releasable connector comprises:

a threaded connector probe and drive motor assembly mounted on the frame, the free end of the probe projecting proud of the lower face of the frame and tapering towards its free end; and a threaded socket mounted on the cover below a tapering guide of a resilient material having a probe receiving mouth and a reducing cross section between the probe receiving mouth and the entrance to the socket.

* * * * *